US007823649B2

(12) United States Patent
Brown et al.

(10) Patent No.: US 7,823,649 B2
(45) Date of Patent: Nov. 2, 2010

(54) SYSTEM AND METHOD FOR PLUGGING A SIDE POCKET MANDREL USING A SWELLING PLUG

(75) Inventors: Clifford D. Brown, Anchorage, AK (US); Robert Warren, Chugiak, AK (US); Lee Smith, Anchorage, AK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/061,243

(22) Filed: Apr. 2, 2008

(65) Prior Publication Data

US 2009/0250227 A1 Oct. 8, 2009

(51) Int. Cl.
*E21B 33/13* (2006.01)

(52) U.S. Cl. ..... 166/386; 166/141

(58) Field of Classification Search ..... 166/117.5, 166/117.6, 179, 387
See application file for complete search history.

(56) References Cited

U.S. PATENT DOCUMENTS

| | | | | |
|---|---|---|---|---|
| 2,849,070 | A | 8/1958 | Maly | |
| 2,945,541 | A | 7/1960 | Maly et al. | |
| 3,385,367 | A | 5/1968 | Kollsman | |
| 3,876,001 | A | 4/1975 | Goode | |
| 4,137,970 | A | 2/1979 | Laflin et al. | |
| 4,333,527 | A * | 6/1982 | Higgins et al. | 166/117.5 |
| 4,524,833 | A | 6/1985 | Hilts et al. | |
| 5,392,853 | A | 2/1995 | Toon | |
| 5,862,859 | A | 1/1999 | Speed et al. | |
| 6,659,178 | B2 | 12/2003 | Wilson et al. | |
| 6,880,642 | B1 | 4/2005 | Garrett et al. | |
| 7,059,419 | B2 | 6/2006 | Greenwell | |
| 7,325,597 | B2 | 2/2008 | Ringgenberg et al. | |
| 2004/0020662 | A1 | 2/2004 | Freyer | |
| 2007/0257405 | A1 | 11/2007 | Freyer | |
| 2007/0257441 | A1 * | 11/2007 | Baaijens et al. | 277/336 |
| 2009/0218107 | A1 * | 9/2009 | Chauffe | 166/387 |

FOREIGN PATENT DOCUMENTS

WO 2005/116394 12/2005

OTHER PUBLICATIONS

Halliburton Marketing Document PES PP Pocket Packer, Jan. 3, 2002, Product No. P.820PP0, pp. 1-4.*

Halliburton Marketing Document, PES PP Pocket Packer, 4 pages (Oct. 9, 2003).

Halliburton Marketing Document, PES PP Pocket Packer Bottom Latch, 4 pages (Jan. 3, 2002).

International Lift Systems, LLC, "Dummy Valves" dated 2004-2008.

* cited by examiner

*Primary Examiner*—David J Bagnell
*Assistant Examiner*—James G Sayre
(74) *Attorney, Agent, or Firm*—Marlin R. Smith

(57) ABSTRACT

Plugging a side pocket mandrel using a swelling plug. A system for plugging a port in a side pocket of a mandrel in a subterranean well includes a plugging device installed in the side pocket of the mandrel, the plugging device including a swellable seal material, whereby the seal material swells at least after installation of the plugging device in the side pocket to thereby prevent fluid transfer through the port. A method of plugging a port in a side pocket of a mandrel in a subterranean well includes the steps of: providing the plugging device with a swellable seal material; installing the plugging device in the side pocket; and the seal material swelling in the side pocket, thereby preventing fluid transfer through the port.

9 Claims, 4 Drawing Sheets

SYSTEM AND METHOD FOR PLUGGING A SIDE POCKET MANDREL USING A SWELLING PLUG

BACKGROUND

The present disclosure relates generally to equipment utilized and operations performed in conjunction with a subterranean well and, in an embodiment described herein, more particularly provides for plugging a side pocket mandrel using a swelling plug.

A gas lift mandrel is a type of side pocket mandrel used in gas lift operations. Gas is flowed through a gas lift valve in the side pocket to thereby reduce the effective density of produced fluid (usually hydrocarbon fluid) and enhance its flow to the surface. Other uses for side pocket mandrels include chemical injection, for example, to retard hydrate formation and/or corrosion of a production tubing string, etc.

Such side pocket mandrels typically include one or more ports for permitting fluid transfer between an interior and exterior of the mandrel. For example, in a mandrel intended for gas lift operations, the ports may permit fluid flow between the interior of a tubing string in which the mandrel is interconnected and an annulus between the tubing string and a surrounding wellbore. In a mandrel intended for chemical injection operations, the ports may permit fluid flow between the interior of the tubing string and a chemical injection line which extends to a chemical source at a remote location.

Unfortunately, side pocket mandrels can sometimes become damaged or otherwise unusable or not needed. For example, one or more of the ports may become flow cut, rendering the mandrel unusable.

In the past, these problems have been resolved by installing a "dummy" valve in the side pocket to plug the ports. Such dummy valves are typically mechanically actuated to extend seals thereon and engage latches with profiles in the side pockets.

However, these sealing and latching mechanisms are not completely reliable, and the seals can be cut or otherwise damaged during the installation process. Therefore, it may be seen that improvements are needed in the art of plugging side pockets in mandrels.

SUMMARY

In the present specification, a system and method are provided which solve at least one problem in the art. One example is described below in which a plugging device is provided with a swellable seal material for engaging a seal bore of a side pocket in a mandrel. Another example is described below in which the plugging device replaces a gas lift valve or other flow control device in the side pocket.

In one aspect, a system for plugging a port in a side pocket of a mandrel in a subterranean well is provided. The system includes a plugging device installed in the side pocket of the mandrel. The plugging device includes a swellable seal material. The seal material swells at least after installation of the plugging device in the side pocket to thereby prevent fluid transfer through the port.

In another aspect, a method of plugging a port in a side pocket of a mandrel is provided which includes the steps of: providing the plugging device with a swellable seal material; installing the plugging device in the side pocket; and the seal material swelling in the side pocket, thereby preventing fluid transfer through the port.

These and other features, advantages, benefits and objects will become apparent to one of ordinary skill in the art upon careful consideration of the detailed description of representative embodiments hereinbelow and the accompanying drawings, in which similar elements are indicated in the various figures using the same reference numbers.

DETAILED DESCRIPTION

It is to be understood that the various embodiments described herein may be utilized in various orientations, such as inclined, inverted, horizontal, vertical, etc., and in various configurations, without departing from the principles of the present disclosure. The embodiments are described merely as examples of useful applications of the principles of the disclosure, which are not limited to any specific details of these embodiments.

In the following description of the representative embodiments of the disclosure, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
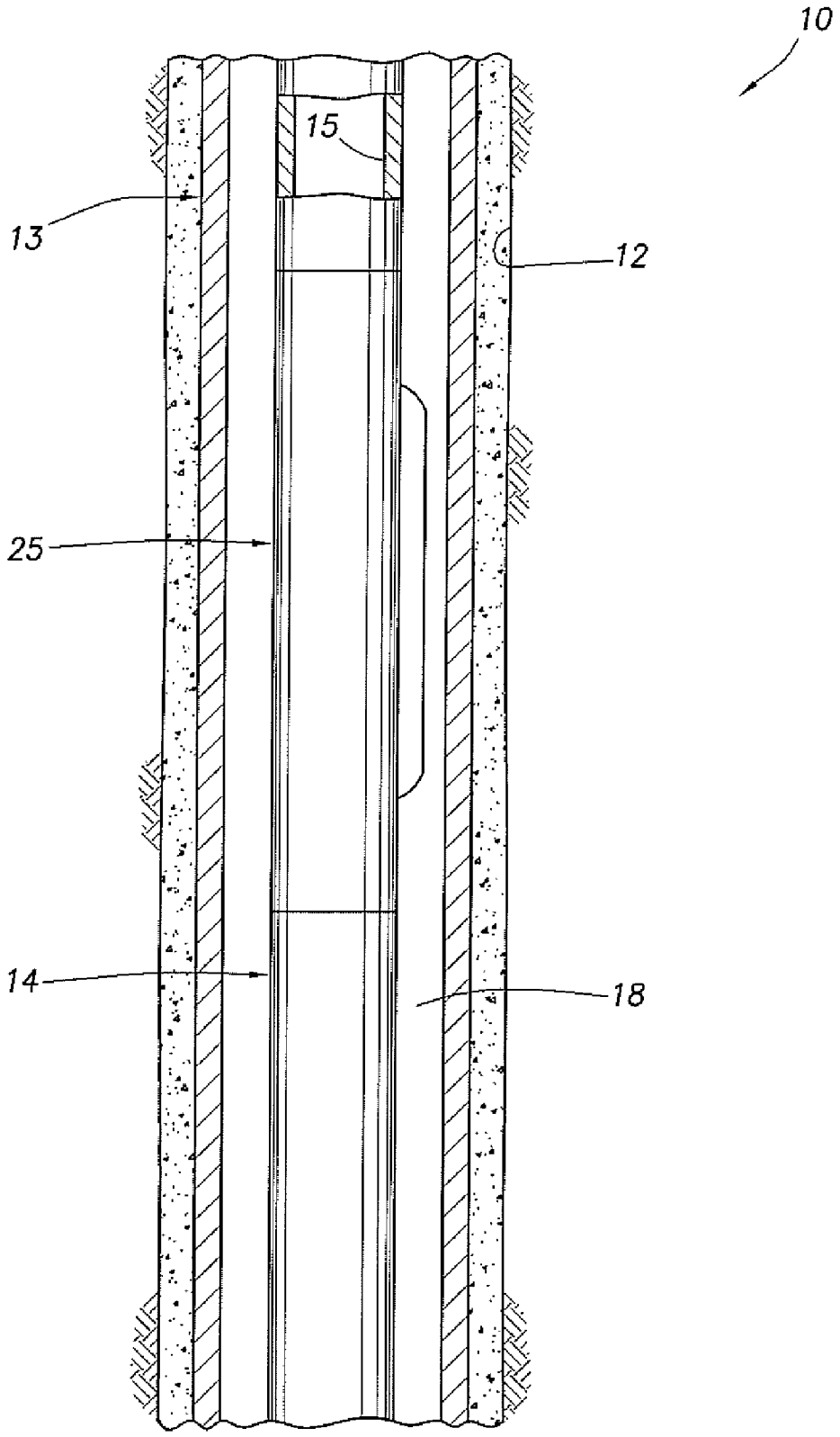
FIG. 1 is a schematic partially cross-sectional view of a well system embodying principles of the present disclosure.

Representatively illustrated in FIG. 1 is a well system 10 which embodies principles of the present disclosure. A wellbore 12 has been drilled and a liner or casing string 13 has been cemented in the wellbore. A production tubing string 14 having a bore 15 is disposed within the casing string 13. An annulus 18 is formed between the tubing and casing strings 13, 14.

Production fluids from a producing formation enter the casing string 13 in the well-known manner, such as through conventional casing perforations (not shown). Production fluids rise in the well, but only to a limited height because the formation pressure is insufficient to force them higher through the tubing string 14.

The tubing string 14 is equipped with a side pocket mandrel 25 which is of the type described in U.S. Pat. No. 4,333,527, the entire disclosure of which is incorporated herein by this reference. The mandrel 25 has the structure of a common orienting type side pocket mandrel as depicted in FIG. 2.

A port 28 is provided in the mandrel 25 for permitting fluid communication between the annulus 18 and the bore 15 of the tubing string 14. Although only one large port 28 is illustrated in FIG. 2, any number and size of ports may be provided as desired. Furthermore, although the mandrel 25 is described herein as being used in a gas lift operation, the mandrel could alternatively be configured for use in other types of operations, such as chemical injection operations, in which case the port 28 would provide for connection to a chemical injection line.

Figure 2:
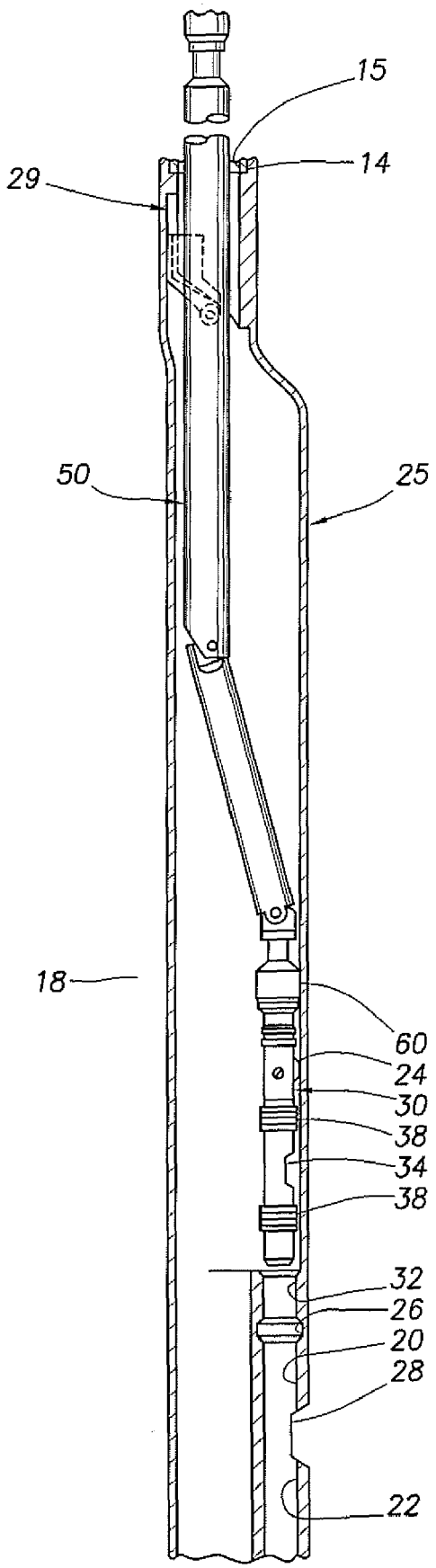
FIG.2 (PRIOR ART)
FIG. 2 is an enlarged scale cross-sectional view of a prior art gas lift side pocket mandrel which may be used in the system of FIG. 1.

Mandrel 25 is shown in FIG. 2 to be provided with an orienting device 29 near its upper end. The orienting device is used to azimuthally orient a kickover tool 50 for installation and removal of a flow control device 30. That is, the orienting device 29 cooperates with the kickover tool 30 to align the kickover tool with a side pocket 32 of the mandrel 25.

The flow control device 30 in this example is a gas lift valve. The gas lift valve is used to control flow of gas through the port 28 between the annulus 18 and the bore 15 of the tubing string 14. When operatively installed in the side pocket 32, seals 38 on the flow control device 30 sealingly engage a seal bore 20 above the port 28 and a seal bore 22 below the port. A latch 24 on the device 30 engages an internal latching profile 26 in the side pocket 32.

The flow control device 30 includes a port 34 which is aligned with the port 28 of the side pocket 32, or at least in fluid communication therewith, when the flow control device is appropriately installed in the side pocket. The seals 38 should isolate the ports 28, 34, so that flow between the port 28 and the bore 15 must pass through the flow control device 30.

After installation, the device 30 is disconnected from a running tool 60 (such as a socket) of the kickover tool 50, and the kickover tool is retrieved from the well. To retrieve the flow control device 30 from the mandrel 25, the above-described process is reversed, except that a pulling tool may be used in place of the running tool 60.

Figure 4:
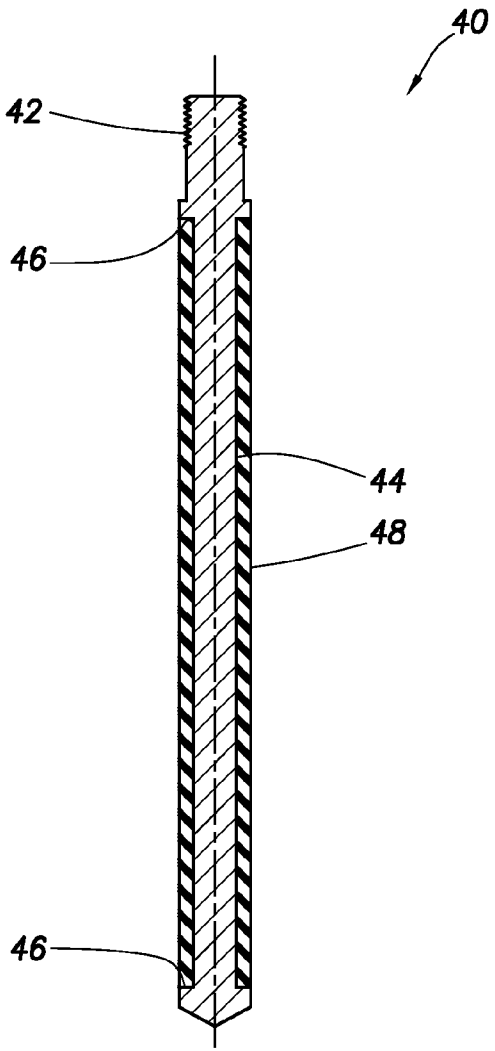
FIG. 4 is a cross-sectional view of the plugging device.
Figure 3:
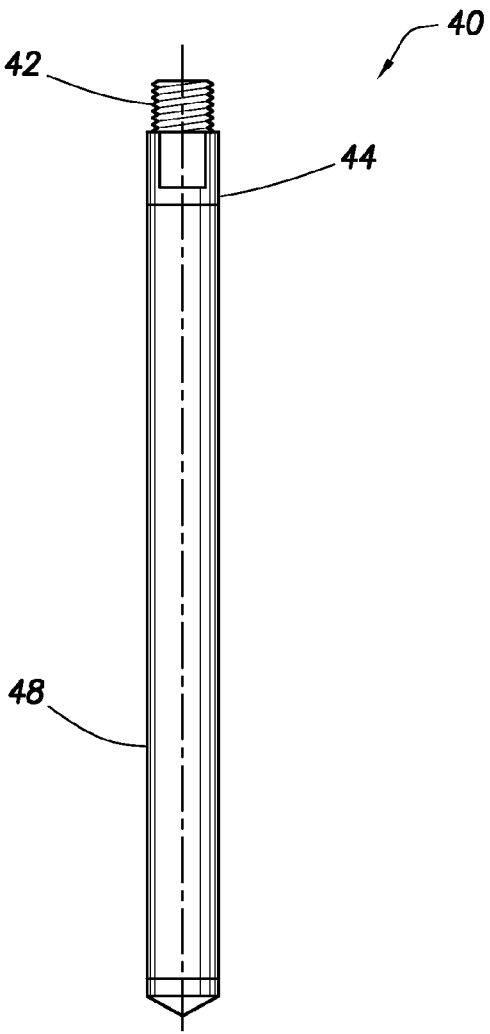
FIG. 3 is a side view of a plugging device which may be used in the system of FIG. 1 embodying principles of the present disclosure.

The kickover tool 50 may also be used to install and retrieve a plugging device 40 which is representatively illustrated in FIGS. 3 & 4, and which embodies principles of the present disclosure. The plugging device 40 may be used to replace the flow control device 30 if, for example, the side pocket 32 or mandrel 25 becomes damaged, unusable or otherwise not needed, and it is desired to prevent fluid transfer through the port 28.

An upper end of the plugging device 40 is provided with external threads 42 for attachment of an adapter (not shown) to allow cooperative engagement with the running tool 60. The threads 42 are formed on a central, longitudinally extending body 44.

The body 44 has inwardly facing, spaced apart shoulders 46 formed thereon. A swellable seal material 48 is secured on the body 44 between the shoulders 46.

Preferably, but not necessarily, the seal material 48 is bonded or otherwise adhered to the body 44 between the shoulders 46. The seal material 48 could, for example, be molded onto the body 44, or the seal material could be formed as a separate tube into which the body is inserted, etc.

When installed in the side pocket 32, the seal material 48 swells, and thereby outwardly extends, in order to sealingly engage the seal bores 20, 22 straddling the port 28 and, thus, prevent fluid transfer through the port. The seal material 48 may also swell somewhat prior to installation of the plugging device 40 in the side pocket 32.

The term "swell" and similar terms (such as "swellable") are used herein to indicate an increase in volume of a seal material. Typically, this increase in volume is due to incorporation of molecular components of the fluid into the seal material itself, but other swelling mechanisms or techniques may be used, if desired. Note that swelling is not the same as expanding, although a seal material may expand as a result of swelling.

For example, in some conventional packers, a seal element may be expanded radially outward by longitudinally compressing the seal element, or by inflating the seal element. In each of these cases, the seal element is expanded without any increase in volume of the seal material of which the seal element is made. Thus, in these conventional packers, the seal element expands, but does not swell.

The fluid which causes swelling of the swellable material 48 could be water and/or hydrocarbon fluid (such as oil or gas). The fluid could be a gel or a semi-solid material, such as a hydrocarbon-containing wax or paraffin which melts when exposed to increased temperature in a wellbore. In this manner, swelling of the material 48 could be delayed until the material is positioned downhole where a predetermined elevated temperature exists.

The fluid could cause swelling of the swellable material 48 due to passage of time. The fluid which causes swelling of the material 48 could be naturally present in the well, or it could be conveyed with the plugging device 40, conveyed separately or flowed into contact with the material 48 in the well when desired. Any manner of contacting the fluid with the material 48 may be used in keeping with the principles of the present disclosure.

Various swellable materials are known to those skilled in the art, which materials swell when contacted with water and/or hydrocarbon fluid, so a comprehensive list of these materials will not be presented here. Partial lists of swellable materials may be found in U.S. Pat. Nos. 3,385,367 and 7,059,415, and in U.S. Published Application No. 2004-0020662, the entire disclosures of which are incorporated herein by this reference.

The swellable material 48 may have a considerable portion of cavities which are compressed or collapsed at the surface condition. Then, when being placed in the well at a higher pressure, the material 48 is expanded by the cavities filling with fluid.

This type of apparatus and method might be used where it is desired to expand the material 48 in the presence of gas rather than oil or water. A suitable swellable material is described in International Application No. PCT/NO2005/000170 (published as WO 2005/116394), the entire disclosure of which is incorporated herein by this reference.

It should, thus, be clearly understood that any swellable seal material which swells when contacted by any type of fluid may be used in keeping with the principles of this disclosure. Swelling of the material 48 may be initiated at any time, but preferably the material swells at least after the plugging device 40 is installed in the side pocket 32.

Figure 5:
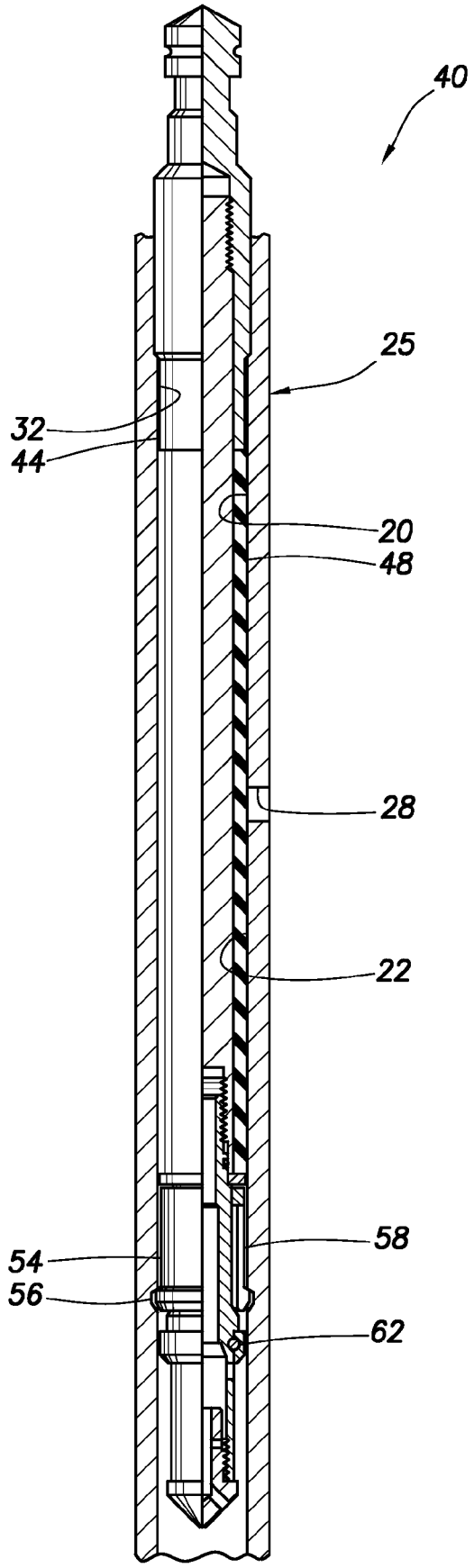
FIG. 5 is a partially cross-sectional view of another configuration of the plugging device installed in a side pocket mandrel.

Referring additionally now to FIG. 5, another configuration of the plugging device 40 is representatively illustrated as being installed in the side pocket 32 of the mandrel 25. In this configuration, the plugging device 40 includes a latch 54 for releasably engaging an internal latch profile 56 formed in the side pocket 32 below the seal bore 22.

In this example, the latch profile 56 is positioned below the port 28, but in other examples, the latch could be above the port 28, and/or above the seal bore 20, similar to the latch profile 26 depicted in FIG. 2.

The latch 54 includes collet-type fingers 58 which engage the profile 56 when the plugging device 40 is appropriately inserted in the side pocket 32. Minimal upward displacement of the plugging device 40 will cause the collet fingers 58 to be outwardly supported and locked into the profile 56, thereby preventing further upward displacement of the plugging device 40. However, a sufficiently great upward force applied to the plugging device 40 will cause a shear ring 62 to shear, thereby permitting the collet fingers 58 to be biased inwardly and out of engagement with the profile 56 and, thus, permit the plugging device 40 to be retrieved from the side pocket 32.

It may now be fully appreciated that the present disclosure provides several advancements in the art of plugging ports in side pocket mandrels. In the example described above, the plugging device 40 does not rely on mechanical actuation to sealing engage the seal bores 20, 22 or to secure the device in the side pocket 32. Instead, the swelling of the seal material 48 accomplishes both of these objectives. Furthermore, the seal material 48 is capable of "healing" itself in the event that it becomes cut or otherwise damaged during installation.

In one aspect, the above disclosure provides a system 10 for plugging a port 28 in a side pocket 32 of a mandrel in a subterranean well. The system 10 includes a plugging device 40 installed in the side pocket 32 of the mandrel 25. The plugging device 40 includes a swellable seal material 48. The seal material 48 swells at least after installation of the plugging device 40 in the side pocket 32 to thereby prevent fluid transfer through the port 28.

The seal material 48 may swell in response to contact with a fluid in the well. The swellable seal material 48 may straddle the port 28 when the plugging device 40 is operatively installed in the side pocket 32.

The side pocket 32 may be configured for receipt of a flow control device 30 therein, and the plugging device 40 may be substituted for the flow control device. The side pocket 32 may include at least two seal bores 20, 22 on opposite sides of the port 28, and the plugging device 40 may sealingly engage each of the seal bores 20, 22 when the plugging device 40 is operatively installed in the side pocket 32.

The above disclosure also provides a method of plugging a port 28 in a side pocket 32 of a mandrel 25 in a subterranean well. The method includes the steps of: providing the plugging device 40 with a swellable seal material 48; installing the plugging device 40 in the side pocket 32; and the seal material 48 swelling in the side pocket 32, thereby preventing fluid transfer through the port 28.

The method may include the step of removing a flow control device 30 from the side pocket 32 prior to the plugging device 40 installing step. The flow control device 30 may be a gas lift valve.

The seal material 48 swelling step may be performed in response to contact between the seal material 48 and a fluid in the well.

The installing step may include straddling the port 28 with the swellable seal material 48. The side pocket 32 may include at least two seal bores 20, 22 on opposite sides of the port 28, and the plugging device 40 installing step may include sealingly engaging each of the seal bores 20, 22 with the swellable seal material 48.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A system for plugging a port in a side pocket of a mandrel in a subterranean well, the system comprising:

a plugging device installed in the side pocket of the mandrel, the plugging device including a swellable seal material, whereby the seal material swells at least after installation of the plugging device in the side pocket to thereby prevent fluid transfer through the port, whereby the seal material secures the plugging device in the side pocket, wherein the side pocket comprises at least first and second seal bores on opposite sides of the port, and wherein a single seal element of the plugging device sealingly engages each of the first and second seal bores, when the plugging device is operatively installed in the side pocket.

2. The system of claim 1, wherein the swellable seal material swells in response to contact with a fluid in the well.

3. The system of claim 1, wherein the swellable seal material straddles the port when the plugging device is operatively installed in the side pocket.

4. The system of claim 1, wherein the side pocket is configured for receipt of a flow control device therein, and wherein the plugging device is substituted for the flow control device.

5. A method of plugging a port in a side pocket of a mandrel in a subterranean well, the method comprising the steps of:

providing the plugging device with a swellable seal material;

installing the plugging device in the side pocket; and the seal material swelling in the side pocket, thereby preventing fluid transfer through the port and securing the plugging device in the side pocket, wherein the side pocket comprises at least first and second seal bores on opposite sides of the port, and wherein the plugging device installing step further comprises sealingly engaging each of the first and second seal bores with a single seal element of the plugging device.

6. The method of claim 5, further comprising the step of removing a flow control device from the side pocket prior to the plugging device installing step.

7. The method of claim 6, wherein in the removing step, the flow control device is a gas lift valve.

8. The method of claim 5, wherein the seal material swelling step is performed in response to contact between the seal material and a fluid in the well.

9. The method of claim 5, wherein the installing step further comprises straddling the port with the swellable seal material.

* * * * *